US006312239B1

(12) United States Patent
Kirsten

(10) Patent No.: US 6,312,239 B1
(45) Date of Patent: Nov. 6, 2001

(54) SCREW-TYPE COMPRESSOR HAVING AN AXIAL BEARING PART ON ONLY ONE ROTOR

(75) Inventor: Guenter Kirsten, Crimmitschau (DE)

(73) Assignee: KT Kirsten Technologie-Entwicklung GmbH, Gornsdorf (DE)

( * ) Notice: Subject to any disclaimer, the term of this patent is extended or adjusted under 35 U.S.C. 154(b) by 0 days.

(21) Appl. No.: 09/529,116

(22) PCT Filed: Oct. 8, 1998

(86) PCT No.: PCT/EP98/06389

§ 371 Date: Jun. 7, 2000

§ 102(e) Date: Jun. 7, 2000

(87) PCT Pub. No.: WO99/18355

PCT Pub. Date: Apr. 15, 1999

(30) Foreign Application Priority Data

Oct. 8, 1997 (DE) ..... 197 44 466

(51) Int. Cl.[7] ..... F04C 18/16

(52) U.S. Cl. ..... 418/76; 418/77; 418/79; 418/201.1; 418/203

(58) Field of Search ..... 418/76, 77, 79, 418/201.1, 203

(56) References Cited

U.S. PATENT DOCUMENTS

| | | | | |
|---|---|---|---|---|
| 2,111,883 | * | 3/1938 | Burghauser | 418/203 |
| 2,871,794 | * | 2/1959 | Mosbacher | 418/201.1 |
| 4,411,607 | * | 10/1983 | Wusthof et al. | 418/79 |
| 5,466,137 | * | 11/1995 | Bierlein et al. | 418/79 |

FOREIGN PATENT DOCUMENTS

| | | | | |
|---|---|---|---|---|
| 84891 | | 5/1970 | (DE) . | |
| 227197 | * | 9/1985 | (DE) | 418/203 |
| 4227332 | | 8/1992 | (DE) . | |
| 947382 | * | 1/1964 | (GB) | 418/77 |

* cited by examiner

*Primary Examiner*—John J. Vrablik
(74) *Attorney, Agent, or Firm*—Diller, Ramik & Wight

(57) ABSTRACT

A screw-type compressor comprises a housing (12) in which a primary rotor (14) and a secondary rotor (16) are arranged each of which is provided with a shaft (18,24) and a screw rotor (20,26). The secondary rotor (16) is axially supported by the primary rotor (14). Only the primary rotor (14) comprises an axial bearing part (22) which is supported in an axial bearing part (66) of the housing (12). The omission of an axial bearing between the secondary rotor and the housing simplifies the support of the secondary rotor.

16 Claims, 3 Drawing Sheets

FIG.2
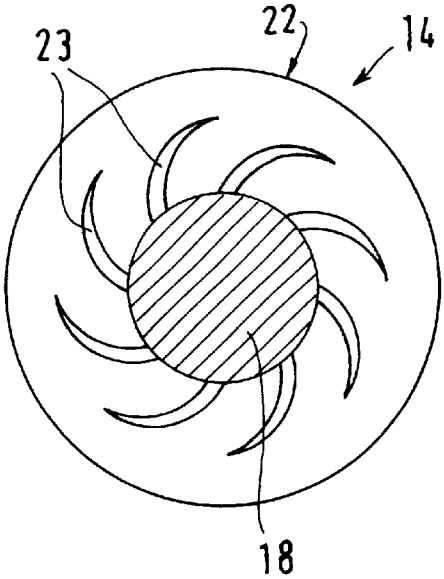
FIG.3
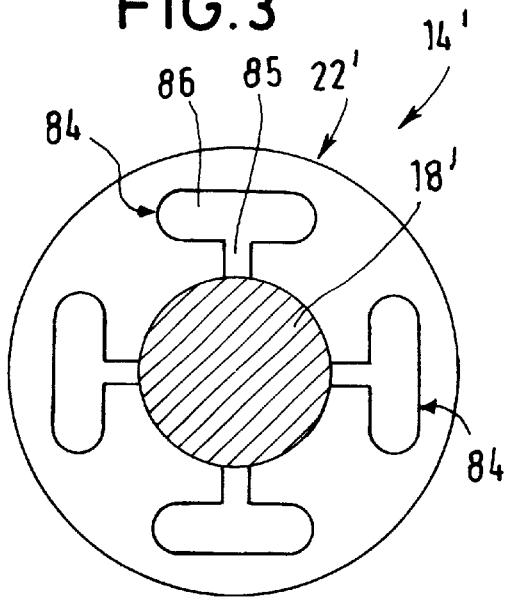
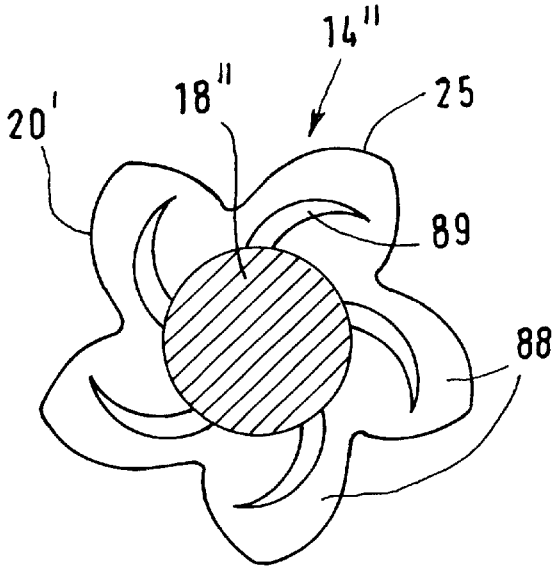
FIG.4

SCREW-TYPE COMPRESSOR HAVING AN AXIAL BEARING PART ON ONLY ONE ROTOR

BACKGROUND OF THE INVENTION

The invention relates to a screw-type compressor comprising a housing in which are arranged a primary rotor and a secondary rotor each having a shaft and a screw rotor.

Screw-type compressors are used for compressing a gaseous substance, e. g. air, and making it available as compressed gas. From DE-A-42 27 332 a screw-type compressor is known wherein a motor-driven primary rotor drives a secondary rotor. The shafts of the primary and secondary rotors are radially supported in roller bearings at both ends. Further, each shaft of the two rotors is axially supported in a plurality of ball bearings at one end. Said axial bearings carry the forces, which occur between the screw rotors during gas compression, in axial direction of the primary and the secondary rotor. The antifriction bearings produce heat during operation, which leads to inhomogeneous heat distribution and thus to stresses in the shaft. From DD-PS 84 891 and U.S. Pat. No. 3,811,805 compressors are known whose primary and secondary rotors are each provided with axial bearings which are configured as slide bearing and thus produce less heat. U.S. Pat. No. 3,275,226 describes a screw-type compressor wherein the primary and secondary rotors are axially supported by antifriction bearings with the primary rotor being additionally axially supported by a disk. The multitude of bearings for the primary and the secondary rotor render the configurations of the known screw-type compressors complicated and their manufacture expensive.

SUMMARY OF THE INVENTION

It is the object of the invention to simplify and improve support of the primary and the secondary rotors in a screw-type compressor.

In the screw-type compressor according to the invention the secondary rotor is axially supported by the primary rotor. Only the primary rotor comprises an axial bearing part which is supported in an axial bearing part of the housing. The secondary rotor is thus directly supported by the housing only via radial bearings. The secondary rotor however is no longer directly supported by the housing via its own axial bearing. The axial forces of the secondary rotor are transmitted via its screw rotor to the screw rotor of the primary rotor. The axial bearing of the primary rotor, formed by the axial bearing parts of the primary rotor and the housing, thus takes up all axial forces of the primary rotor and the secondary rotor.

By omission of the axial bearing between secondary rotor and housing the overall complexity with regard to support of the primary and the secondary rotor is reduced by at least one (axial) bearing.

An axial bearing supported by the housing is provided only for the primary rotor with the majority of the axial forces occurring during gas compression acting upon said bearing. The secondary rotor, upon which acts a considerably less amount of the axial forces produced during gas compression, is supported via the tooth flanks of its screw rotor at the screw rotor of the primary rotor.

The primary rotor is provided with the only axial bearing since larger axial forces act upon the primary rotor than on the secondary rotor. In this configuration only the relatively low axial forces of the secondary rotor need to be transmitted via the screw rotor teeth onto the primary rotor. Generally the secondary rotor may also be axially supported via an axial bearing at the housing while the primary rotor is axially supported via the screw rotors at the secondary rotor and thus does not comprise its own axial bearing connected with the housing.

In a preferred embodiment the axial bearing formed by the axial bearing parts is configured as slide bearing. The radial bearings, too, may be executed as slide bearings. The configuration of the axial slide bearing is simpler than that of an antifriction bearing and thus facilitates low-cost manufacture of the screw-type compressor. Slide bearings further present the advantage that they do not produce any appreciable heat so that the rotor shafts remain stressfree even at high speeds. The slide bearing may be lubricated with the same medium which is also used as lubricating and sealing agent in the compression chamber of the screw-type compressor. Oil or water may serve as gliding, lubricating and sealing fluid. However, air may also be used as slide bearing fluid.

When the primary rotor is belt-driven, an antifriction bearing is preferably used as radial bearing on the drive side since slide bearings are not suited for accommodating extremely high radial stresses.

In a preferred embodiment axial thrust forces of the secondary rotor are axially countered by the primary rotor exclusively via the front end faces of the meshing teeth of the screw rotors bearing against a bearing disk. The teeth of the screw rotors may be configured such that only very low axial forces or none at all occur on the secondary rotor so that these low axial thrust forces of the secondary rotor can without any problems be transmitted via the secondary screw rotor teeth to the primary rotor. A further means for transmitting the axial forces from the secondary rotor to the primary rotor is not required.

The secondary rotor preferably comprises an axial tensioning means which axially biases the secondary rotor. The axial tensioning means is not provided with a stop which could support the secondary rotor but applies a constant biasing force to the secondary rotor, preferably the secondary rotor shaft, the biasing force substantially corresponding to the anticipated axial stress acting on the secondary rotor during gas compression. The tensioning means thus substantially compensates for the axial forces acting upon the secondary rotor so that only very low axial forces or none at all have to be transmitted from the secondary rotor to the primary rotor. In a preferred embodiment the axial tensioning means is configured as a hydraulic tensioning means acting upon the shaft or the screw rotor of the secondary rotor. The tensioning means may also be supplied with air.

The axial bearing part of the primary rotor is preferably arranged on the screw rotor of the primary rotor. It is not the shaft of the primary rotor but the screw rotor of the primary rotor which is supported by the housing. The screw rotor, at which occur the axial forces produced by pressure generation as well as those transmitted by the secondary rotor, is directly supported by the housing which takes up the axial forces without any transmission via another component. Thus the primary rotor does not apply any axial stresses to the shaft so that the shaft is loaded to a smaller degree by corresponding torques and shearing forces.

In a preferred embodiment the axial bearing part of the primary rotor is configured as an axial front wall of the screw rotor. The axial bearing part of the housing is executed as an annular disk-shaped running face with the two axial bearing parts together forming the slide bearing. The front wall of the primary rotor screw rotor thus forms a bearing face supported on the ring-shaped running face of the housing. In this configuration no bearing-specific parts must be provided on the primary rotor. This renders manufacture of the primary rotor less expensive.

In an alternative embodiment the primary rotor comprises a slide bearing disk on an axial front end face of the screw rotor, which forms, together with an axial bearing part running face of the housing, the slide bearing.

On a front end face of the rotor of the primary rotor a ring-shaped slide bearing disk is provided which forms a closed radial running surface.

The screw rotor front wall or the slide bearing disk preferably comprises substantially radial grooves for a gliding fluid. The gliding fluid, which is introduced near the shaft or at the basis of the screw rotor, can be fed by the centripetal forces via said grooves to the outside. In this way a gliding film is produced over the overall radius and circumference of the screw rotor.

In a preferred embodiment the grooves take an arcuate path with the outer end of each groove, as seen in radial direction, being curved in a direction opposite to the sense of rotation of the rotor. This results in very uniform gliding fluid distributions over the overall radius and circumference of the screw rotor.

The grooves are preferably T-shaped with the vertical part being arranged radially and the horizontal part being arranged tangentially in circumferential direction. The T-shaped grooves allow good lubrication of the slide bearing in both running directions of the primary rotor.

In a preferred embodiment a front end face of the secondary rotor screw rotor is axially supported on the slide bearing disk of the primary rotor. The front faces of the rotor teeth of the secondary rotor abut the rotorside end of the slide bearing disk. Thus an axial support of the secondary rotor is realized by simple means so that even larger axial forces can be transmitted.

In a preferred embodiment the screw rotor, the shaft and the slide bearing disk of the primary rotor are integrally formed. The primary rotor may be manufactured from a composite material by casting, injection molding etc. in a negative mold.

Alternatively the slide bearing disk may be separately configured and cast, bolted or in any other way fastened to the shaft and/or the screw rotor of the primary rotor. In the case of separate manufacture of the slide bearing disk and the primary rotor different materials may be selected for shaft, rotor and slide bearing disk, which can be better adapted to the respective physical requirements of the respective component. The screw rotor may, for example, be milled from a composite material in a conventional manner and the metal slide bearing disk may subsequently be bolted to the screw rotor.

According to a preferred embodiment a special radial bearing running layer is applied to the shaft of the primary or the secondary rotor. The primary rotor may, for example, be manufactured integrally, and subsequently a super-gliding agent for the radial bearing may be applied to the shaft.

BRIEF DESCRIPTION OF THE DRAWINGS

Hereunder embodiments of the invention are explained in detail with reference to the drawings in which:

FIG. 2 shows a first embodiment of the axial bearing parts of the primary rotor, FIG. 3 shows a second embodiment of an axial bearing part of the primary rotor, FIG. 4 shows a third embodiment of an axial bearing part of the primary rotor.

DESCRIPTION OF THE PREFERRED EMBODIMENTS

Figure 1:
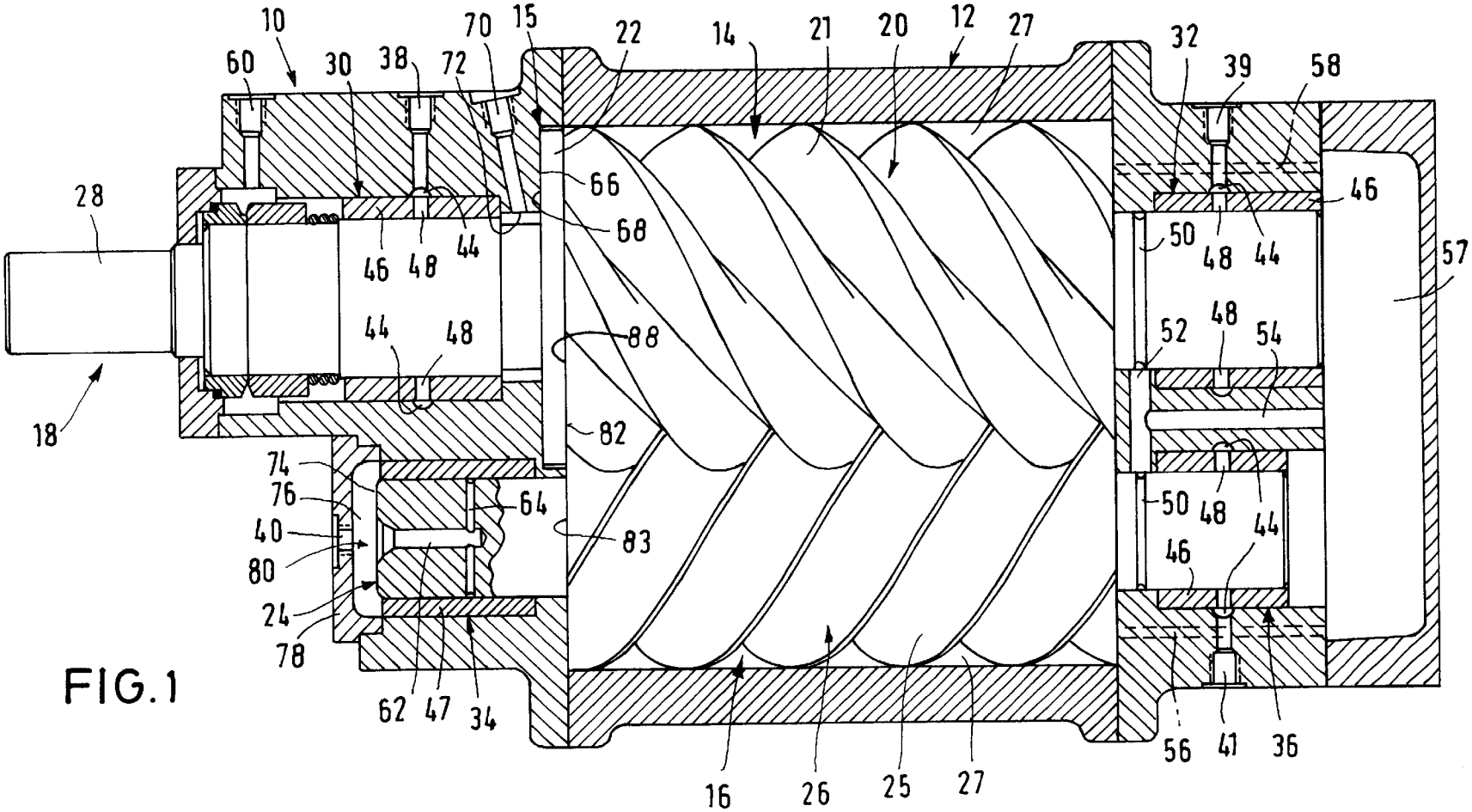
FIG. 1 shows a screw-type compressor comprising a primary rotor having an axial slide bearing, and a secondary rotor axially supported by the primary rotor.

FIG. 1 shows a screw-type compressor 10 which serves for generation of an oilfree compressed gas, e. g. air. The screw-type compressor 10 comprises a housing 12 in which a primary rotor 14 and a secondary rotor 16 are arranged axially parallel to each other. The primary rotor 14 substantially comprises a shaft 18, a screw rotor 20 and a slide bearing disk 22 which serves as axial bearing part of the primary rotor 14. The secondary rotor 16 is substantially provided with a shaft 24 and the screw rotor 26. Both the shaft 24 and the screw rotor 26 of the secondary rotor have a smaller diameter than the shaft 18 and the screw rotor 20 of the primary rotor 14. Both the primary rotor 14 and the secondary rotor 16 are manufactured integrally from a composite material.

The primary rotor 14 can be driven via a shaft stub 28 which extends from the housing 12. The drive is preferably carried directly via an electric motor which is axially aligned with the longitudinal axis of the primary rotor.

To take up the radial forces acting upon the primary rotor 14 the primary rotor shaft 18 is supported via two radial bearings 30,32 in the housing 12. The secondary rotor 16, too, is supported via two radial bearings 34,36 in the housing 12. All radial bearings 30,32,34,36 are configured as slide bearings. The space enclosed by the housing 12, in which the primary rotor screw rotor 20 and the secondary rotor screw rotor 26 are arranged, forms the compression chamber 27 of the screw-type compressor 10 where the gas is compressed. The housing 12 comprises a gas opening, which is not shown, on the shaft stud 28 side through which the gas to be compressed can flow into the compression chamber 27. In the chambers formed by the teeth 21,25 of the screw rotors 20,26, i. e. the compression chamber 27, the gas is compressed and discharged in compressed form at the opposite axial end of the compression chamber 27 via an opening in the housing, which is not shown. This discharge side of the screw-type compressor or the primary and secondary rotors 14,16 is referred to as delivery side.

The radial bearings 30,32 and 36 have generally the same configuration. Via a gliding fluid inlet 38,39,41 a gliding fluid, i. e. water, flows into an annular groove 44. On each shaft 18, 24 a bearing bush 46, which is surrounded by an annular groove 44, is seated which comprises three radial bores 48 through which the gliding fluid can flow onto the outer circumference of the respective shaft 18, 24.

On the two delivery-side radial bearings 32,36 the gliding fluid is axially distributed along the shaft 18,24 with the gliding fluid flowing towards the compression chamber 27 being fed via an annular groove 50 and collecting ducts 52,54 into a gliding fluid collecting chamber 57. Via two bores 56,58 the gliding fluid is injected into the compression chamber 27.

In the drive-side radial bearing 30 of the primary rotor 14 the gliding fluid flows along the bearing bush 46 in both axial directions, i. e. towards a gliding fluid discharge 60 and towards the slide bearing disk 22.

In the the secondary rotor 16 radial bearing 34 averted from the delivery side the gliding fluid flows through an axial shaft bore 62 and three radial bores 64 of the shaft 24, which are arranged relative to each other at an angle of 120°, to the shaft circumference or the bearing bush 47. From there the gliding fluid flows on the shaft circumference towards the compression chamber 27.

The primary rotor 14 comprises an axial bearing 15 which is configured as a slide bearing. One axial bearing part of the axial bearing 15 is formed by the slide bearing disk 22 arranged at a front end face 88 of the screw rotor 20 and terminating the latter in axial direction. The other axial bearing part is formed by an annular disk-shaped running face 66 of the housing 12. The annular disk-shaped running faces 68,66 of the slide bearing disk 22 and the housing 12, respectively, together form a slide bearing which supports the screw rotor 20 of the primary rotor 18 directly at the housing 12.

The gliding fluid for the axial bearing 15 is fed via an intake 70 of an annular groove 72 to the primary rotor shaft 18 which axially extends up to the slide bearing disk 22. The gliding fluid is supplied at a pressure of approximately 10 bar which substantially corresponds to the compressed gas pressure.

According to FIG. 2 the slide bearing disk 22 comprises a plurality of grooves 23 which radially extend to the outside in an arcuate manner and taper to a point, through which the gliding fluid is fed to the outside by the centripetal forces occurring during rotation of the primary rotor 14.

The gliding fluid leaves the grooves 23 of the slide bearing disk 22 and forms a fluid film between the running faces 66,68 of the housing 12 and the axial bearing 15, respectively, which ensures sliding support. The gliding fluid continues to flow to the outside and finally enters the compression chamber 27.

The teeth 25 of the screw rotor 26 of the secondary rotor 16 mesh with the teeth 21 of the screw rotor 20 of the primary rotor 14. Via the tooth flanks of the teeth 21 and 25 axial forces of the secondary rotor 16 are transmitted to the teeth 21 of the primary rotor 14.

In the area of the front end face 74 of the shaft 24 of the secondary rotor 16 a fluid chamber 76 is enclosed by a cover 78 of the housing 12, into which the gliding fluid for the radial bearing 34 is fed via the intake 40. The gliding fluid acts as a fluid pressure of approximately 10 bar on the front end face 74 of the shaft 24 thus applying a force in axial direction to the secondary rotor 16, which counteracts the axial force produced during gas pressure generation and acting upon the secondary rotor 16. This configuration thus acts as a fluidic or pneumatic axial tensioning means 80 which axially cushions the secondary rotor 16 but does not comprise any stop for fixing the secondary rotor 16 in a given axial position.

Besides the axial tensioning means 80 and the axial support of the secondary rotor via the screw rotors 20,26 the secondary rotor is further supported by the rear side 82 of the slide bearing disk 22 which supports front end faces 83 of the teeth 25 of the secondary rotor screw rotor 26.

FIG. 3 shows a second embodiment of a slide bearing disk 22' where the T-shaped gliding fluid grooves 84 are arranged. The vertical groove 85 is radially arranged and the horizontal groove is tangentially arranged. In this configuration of the grooves 84 the primary rotor 14' can be operated in both senses of rotation with adequate lubrication being ensured in both senses of rotation.

FIG. 4 shows another embodiment of the primary rotor 14" wherein no slide bearing disk is provided but the front end face 88 of the teeth 25 serve as slide bearing face. For better distribution of the gliding fluid arcuate grooves 89 are arranged in the front end face 88.

Figure 5:
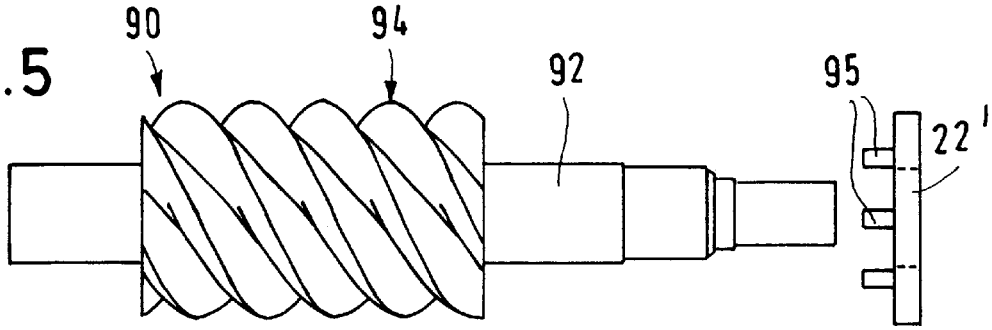
FIG. 5 shows a first embodiment of a primary rotor with a separate slide bearing disk.

In FIG. 5 a primary rotor 90 is shown which substantially comprises two parts: the shaft 92 which is manufactured integrally with the screw rotor 94, e. g. from a composite or a metallic material, and the slide bearing disk 22' which is manufactured from a material with good sliding properties. The slide bearing disk 22' is provided with four axial driving lugs 95 which fit into mating bores of the screw rotor 94.

Figure 6:
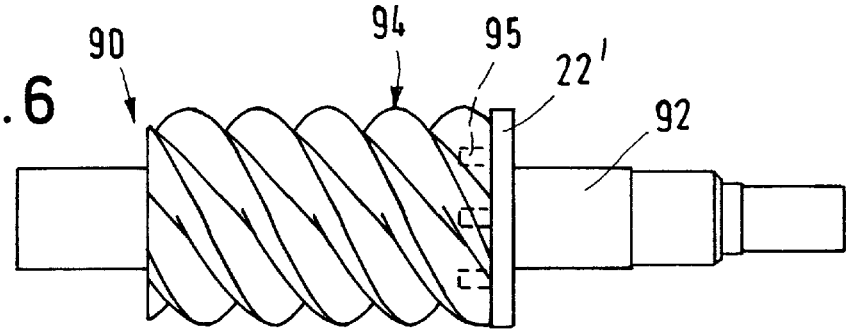
FIG. 6 shows the primary rotor and the mounted slide bearing disk of FIG. 5.

As shown in FIG. 6 the slide bearing disk 22' is pushed onto the shaft 92 and the driving lugs 95 are inserted into the mating openings of the screw rotor 94. The slide bearing disk 22' is then bolted to the screw rotor 94.

Alternatively the slide bearing disk can be manufactured separately and subsequently be cast integral with the primary rotor 90 when the latter is cast.

Figure 7:
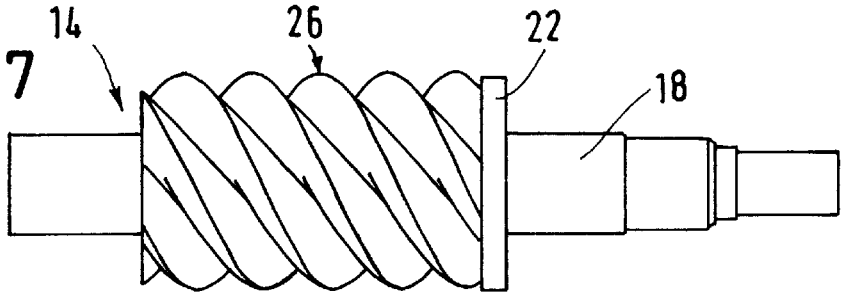
FIG. 7 shows a second embodiment of the integral primary rotor.

FIG. 7 shows the primary rotor 14 of FIG. 1.

Figure 8:
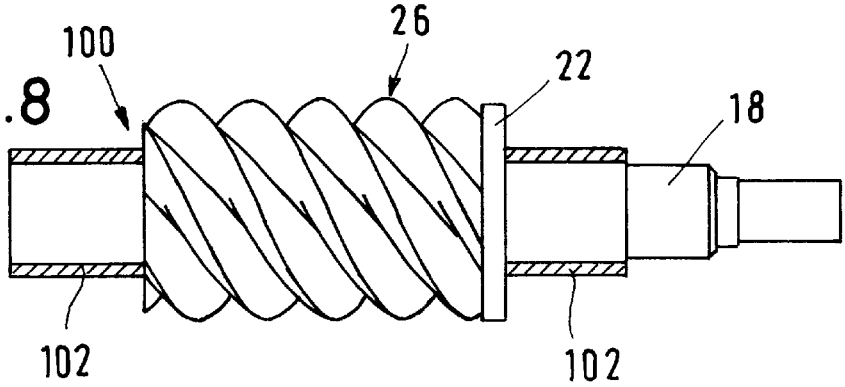
FIG. 8 shows a third embodiment of a primary rotor to whose shaft a radial bearing running layer is applied.

In FIG. 8 a primary rotor is shown wherein a radial bearing running layer 102 is applied to the shaft 18 on both sides of the screw rotor 26, which presents better gliding properties than the shaft material and may be manufactured from so-called super-gliding materials.

Although a preferred embodiment of the invention has been specifically illustrated and described herein, it is to be understood that minor variations may be made in the apparatus without departing from the spirit and scope of the invention, as defined the appended claims.

What is claimed is:

1. A screw-type compressor comprising a housing (12), said housing defining a compression chamber (27); a primary rotor (14) having a primary shaft (18) and a primary screw rotor (20), a secondary rotor (16) having a secondary shaft (24) and a secondary screw rotor (26), said primary screw rotor (20) and said secondary screw rotor (26) being in meshed relationship in said compression chamber (27), means supporting said shafts (18, 20) for rotation, said primary screw rotor (20) and said secondary screw rotor (26) each having a respective front face (88, 83), a thrust bearing (15) located between said primary screw rotor front end face (88) and an axially opposing face (66) of said housing (12) for countering axial thrust forces generated upon rotation of said screw rotors (20, 26), and said secondary screw rotor front end face (83) being in axial opposing contact with said thrust bearing (15) to thereby counter axial thrust forces of said secondary screw rotor (26).

2. The screw-type compressor as defined in claim 1 wherein said thrust bearing (15) is a radial bearing.

3. The screw-type compressor as defined in claim 1 wherein said primary screw rotor (20) and said secondary screw rotor (26) have respective meshing teeth (21, 25), and said secondary screw rotor front end face (83) is at least in part defined by said secondary screw rotor teeth (25).

4. The screw-type compressor as defined in claim 1 wherein said compression chamber (27) includes a fluid suction side and a fluid discharge side, and means (80) for imparting axial forces to said secondary rotor (16) in a direction toward said fluid discharge side.

5. The screw-type compressor as defined in claim 1 wherein said compression chamber (27) includes a fluid suction side and a fluid discharge side, and means (80) for imparting fluidic axial forces to said secondary rotor (16) in a direction toward said fluid discharge side.

6. The screw-type compressor as defined in claim 1 wherein said thrust bearing part (15) is in external telescopic relationship to said primary shaft (18).

7. The screw-type compressor as defined in claim 1 wherein said secondary screw rotor front end face (83) defines a running surface in relation to said thrust bearing part (15).

8. The screw-type compressor as defined in claim 1 wherein the primary shaft (18) and the slide bearing disk (22) are integrally formed.

9. The screw-type compressor as defined in claim 1 wherein the slide bearing disk (22') is connected to one of the primary shaft (18) and the primary screw rotor (20).

10. The screw-type compressor as defined in claim 1 wherein radial bearings (102) are applied to at least one of the primary shaft (18) and the secondary shaft (24).

11. The screw-type compressor as defined in claim 1 wherein the secondary screw rotor (26) includes teeth (25), axial end faces of said teeth (25) are defined by said secondary screw rotor front end face (83), and said secondary screw rotor teeth end faces are in axial opposing contact with said thrust bearing (15).

12. The screw-type compressor as defined in claim 1 wherein said thrust bearing (15) is a slide bearing.

13. The screw-type compressor as defined in claim 12 wherein the axial support of the secondary rotor (16) provided by the primary rotor (14) is provided exclusively via the meshing teeth (21, 25) of the screw rotors (20, 26).

14. The screw-type compressor as defined in claim 1 wherein said primary screw wall front end face (88) and the slide bearing disk (22) include substantially radial grooves (23, 89) for gliding fluid.

15. The screw-type compressor as defined in claim 14 wherein the substantially radial grooves (23, 89) define an arcuate path.

16. The screw-type compressor as defined in claim 14 wherein the substantially radial grooves (84) are T-shaped.

* * * * *